US005649276A

United States Patent [19]

Quesnel et al.

[11] Patent Number: 5,649,276

[45] Date of Patent: Jul. 15, 1997

[54] USE OF CONICAL DRIVE ROLLS IN A STALLED ROLL REGISTRATION SUBSYSTEM TO PREVENT CREASING

[75] Inventors: Lisbeth S. Quesnel, Pittsford; Frank C. Darling, Jr., Wolcott, both of N.Y.

[73] Assignee: Xerox Corporation, Stamford, Conn.

[21] Appl. No.: 427,363

[22] Filed: Apr. 24, 1995

[51] Int. Cl.[6] ..... G03G 15/00

[52] U.S. Cl. ..... 399/390; 271/242; 399/396

[58] Field of Search ..... 355/308, 309, 355/317, 321; 271/242, 272; 492/16, 18, 20, 25, 26, 27; 399/388, 390, 396, 394

[56] References Cited

U.S. PATENT DOCUMENTS

| | | | |
|---|---|---|---|
| 3,175,824 | 3/1965 | Albosta | 271/272 X |
| 3,863,913 | 2/1975 | Hirafuji | 271/272 X |
| 3,929,327 | 12/1975 | Olson | 271/272 X |
| 3,954,261 | 5/1976 | Greene et al. | 271/272 X |
| 3,999,038 | 12/1976 | Sikes, Jr. et al. | 219/216 X |
| 4,025,187 | 5/1977 | Taylor et al. | 355/317 |
| 4,188,025 | 2/1980 | Gusfafson et al. | 271/272 X |
| 4,523,832 | 6/1985 | Strutt et al. . | |
| 4,933,726 | 6/1990 | Moriyama | 355/309 |
| 5,078,384 | 1/1992 | Moore | 271/228 |
| 5,156,391 | 10/1992 | Roller | 271/227 |
| 5,219,159 | 6/1993 | Malachowski et al. | 271/242 X |
| 5,253,862 | 10/1993 | Acquaviva et al. | 271/251 |

FOREIGN PATENT DOCUMENTS 57-175643 10/1982 Japan .

OTHER PUBLICATIONS

Xerox Disclosure Journal, vol. 10, No. 1 Jan./Feb., 1985, p. 17 Inventor: Schoppe, et al.

*Primary Examiner*—Matthew S. Smith
*Attorney, Agent, or Firm*—Kevin R. Kepner

[57] ABSTRACT

A stalled roll registration device that minimizes or prevents creasing of a sheet as it is fed through the device. The rolls that register the sheet are not perfectly cylindrical and have a larger radius toward the outside edges of the sheetpath. After the sheet is stalled and then started through the registration pair, the velocity difference caused by the non-cylindrical rolls causes the edges of the sheet to be urged toward the edges of the sheetpath thereby minimizing the risk of wrinkling the sheet.

8 Claims, 2 Drawing Sheets

USE OF CONICAL DRIVE ROLLS IN A STALLED ROLL REGISTRATION SUBSYSTEM TO PREVENT CREASING

This invention relates generally to a sheet registration device, and more particularly concerns a drive roll for a stalled roll registration system which minimizes the chance of sheet creasing as the sheet is forwarded through the stalled roll.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, it is necessary to align and register the individual cut sheets so that the developed image is placed in the proper location on the sheet. Various schemes have been developed to assure that the image receiving sheet is in the proper location and forwarded at the proper time. Some complex printing machines utilize various sensors and translating nips to align the sheet in the proper position for receiving the image. Other machines utilize variable speed stepping motors to differentially drive a sheet within a sheet path for deskew and registration purposes. Both of these registration methods require sophisticated control and are relatively high cost.

Another method for registering and aligning a sheet is the use of stalled rolls. In the stalled roll technique, a sheet is driven into a nip in which the rolls are stopped causing a buckle to be formed between the stalled roll and the driving rolls. The force of the buckle causes the lead edge of the sheet to align itself within the stalled nip and the stalled nip is then activated so that the sheet is forwarded in the proper aligned position. One problem with stalled rolls is that when the sheet is forwarded through the stalled nip the sheet may be creased due to the registration buckle being uneven across the width of the sheet. This can This can cause the sheet to be folded or creased at the center portion as it is driven through the stalled nip.

Accordingly it is desirable to devise an inexpensive stalled roll registration device that will not crease the sheet as it is forwarded through the nip. The following disclosures may be relevant to various aspects of the present invention.

U.S. Pat. No. 5,156,391

Patentee: Roller

Issue Date: Oct. 20, 1992

U.S. Pat. No. 5,253,862

Patentee: Acquaviva, et al

Issue Date: Oct. 19, 1993

U.S. Pat. No. 5,078,384

Patentee: Moore

Issue Date: Jan. 7, 1992

U.S. Pat. 4,523,832

Patentee: Strutt, et al

Issue Date: Jun. 18, 1985

JP-57-175643

Patentee: Eisaku Saiki

Issue Date: Oct. 28, 1982

Xerox Disclosure Journal

Vol. 10, No. 1

January/February, 1985, Pg. 17

Inventor: Schoppe, et al

The relevant portion of the foregoing disclosures may be briefly summarized as follows:

U.S. Pat. No. 5,156,391 describes an apparatus and method to deskew sheets in the short paper path by differentially driving two sets of rolls so as to create a paper buckle buffer zone in the sheet and then differentially driving a roll set to correct skew while the sheet is still within the nips of multiple drive roll sets.

U.S. Pat. No. 5,253,862 discloses a sheet handler including an idler and driven cross roller set. The rollers are preloaded so that a normal force exists between the rollers at the nip. The nip is provided with an apparatus for adjusting the preloaded force to adjust the normal force on the sheet material passing through the nip.

U.S. Pat. No. 5,078,384 discloses a method and apparatus for deskewing and registering a sheet, including the use of two or more selectably controllable drive rolls operating in conjunction with sheet skew and lead edge sensors for frictionally driving and deskewing sheets having variable lengths. Sheets will be advanced to reach a predetermined registration position at a predetermined velocity and time at which time the sheets will no longer be frictionally engaged by the drive rolls.

U.S. Pat. No. 4,523,832 describes a sheet transport, including an outer curve guide surface input, either intermediate and output drive rolls, spaced apart less than the length of the drive sheet. The disengageable output drive nip cooperates with an opposed guide surface and one or more retractable stops to achieve registration of the copy sheet with the image.

JP-57-175643 describes a stalled roll technique of deskewing whereby the leading edge of a sheet is fed into the bite point of a set of stationary rollers causing the sheet to be deformed into a line by means of force supplied by a paper buckle along the stationary rolls, at which time the rolls are activated and the sheet is driven to the next station or set of rolls.

Xerox Disclosure Journal, Vol. 10, No. 1, Pg. 17, describes a single revolution electromagnetic friction clutch having feed rollers which are segmented rather than traditional full circumference feed rolls or wheels. The segmented feed rolls are utilized to forward a sheet until a predetermined sensor is actuated at which time the roll is engaged and the segmented portion disengages from the sheet, allowing the sheet to be forwarded by a secondary drive nip.

In accordance with one aspect of the present invention, there is provided an apparatus for registering a sheet in a path. The apparatus comprises an idler member located in the path and a drive member in contact with said idler member to form a nip therebetween, said drive member being non-cylindrical, so that the effective velocity of said drive member at a first edge and a second edge of the sheet path is greater than an effective velocity of the drive member at a center of the sheet path.

Pursuant to another aspect of the present invention, there is provided a printing machine in which a sheet is driven along a path and fed in a timed relationship and registration position to a process station. The machine comprises an idler member located in the path and a drive member in contact with said idler member to form a nip therebetween, said drive member being non-cylindrical, so that the effective velocity of said drive member at a first edge and a second edge of the sheet path is greater than an effective velocity of the drive member at a center of the sheet path.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
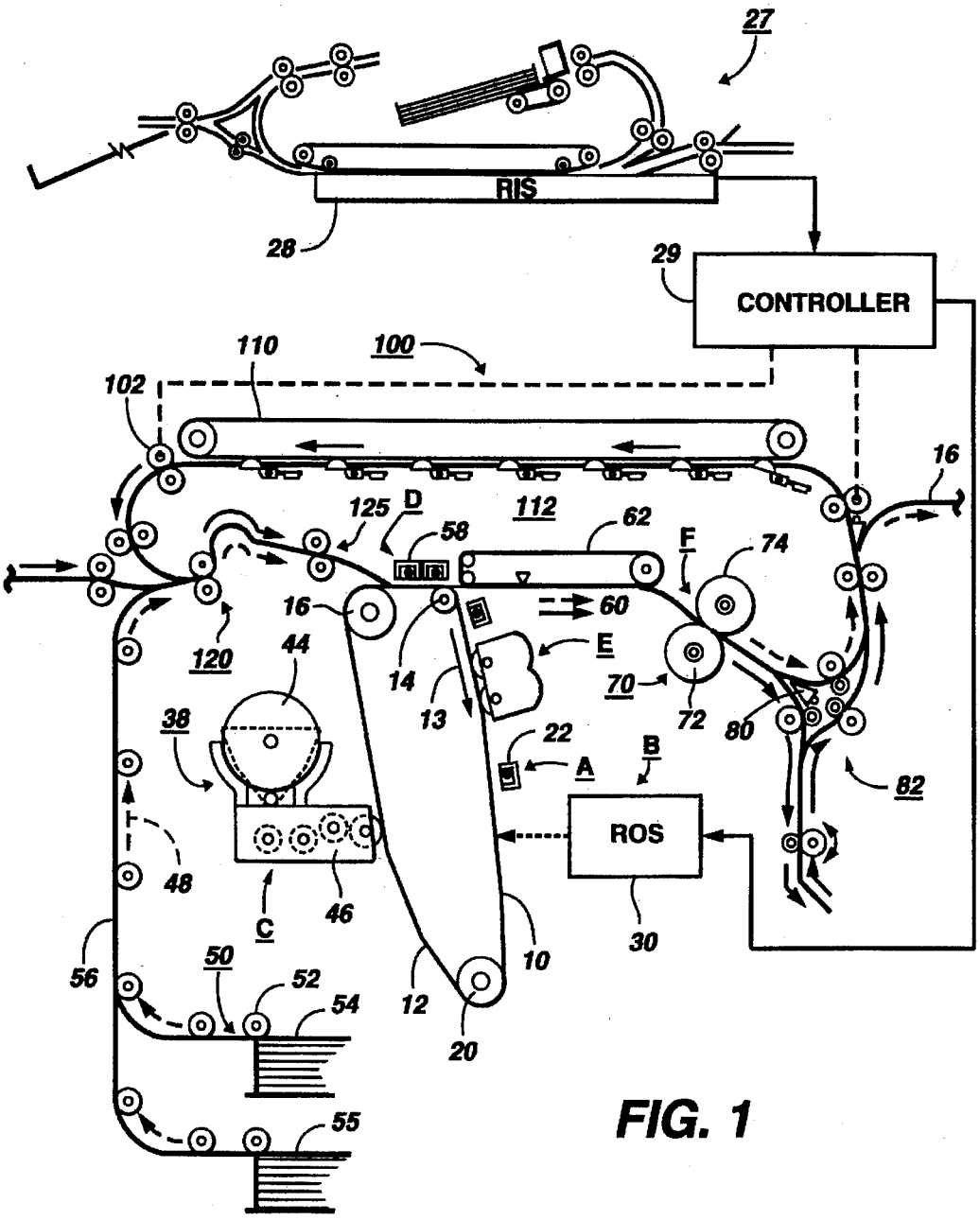
FIG. 1 is a schematic elevational view of a typical electrophotographic printing machine utilizing the sheet deskew and registration device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the stalled roll registration device of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 16. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, described in further detail below, for recirculation back through transfer station D and fuser 70 for receiving and permanently fixing the side two image to the backside of that duplex sheet, before it exits via exit path 16.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2A:
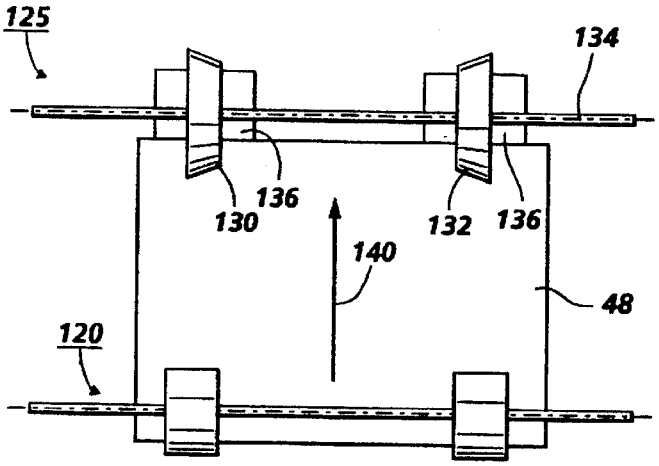
FIGS. 2A, 2B and 2C are detailed plan views of the sheet registration and deskewing device of the present invention illustrating a sheet deskewing and feeding cycle thereof.
Figure 2B:
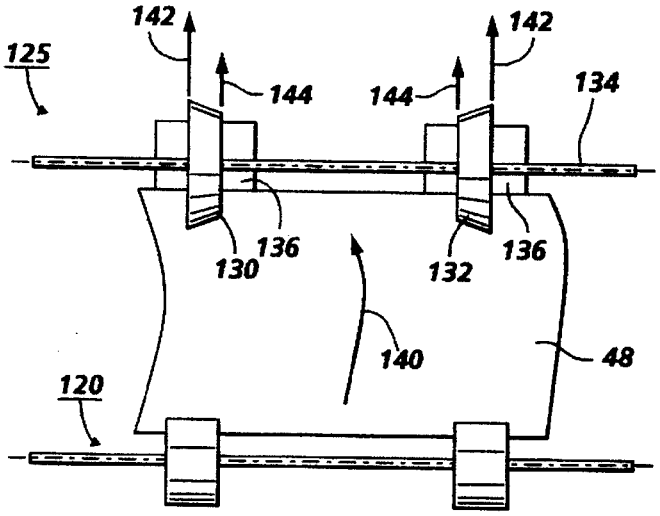
Figure 2C:
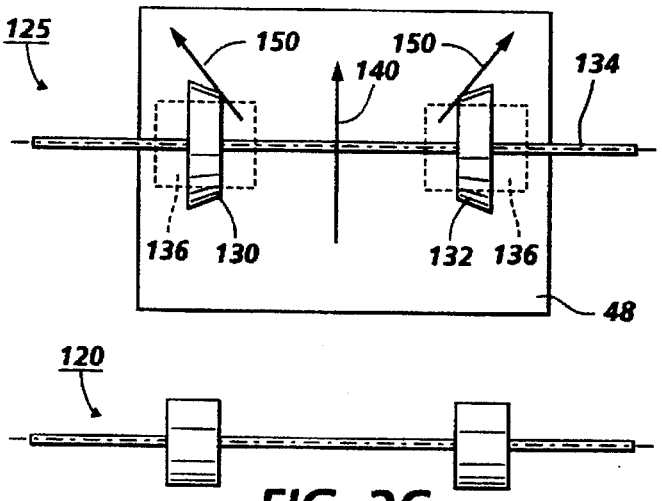

Turning now to FIGS. 2A through 2C inclusive, there is illustrated detailed plan views of a cycle of the stalled roll registration system of the present invention. Stalled roll registration can be accomplished with either a full width roll configuration or with segmented rolls. The preferred embodiment utilizes segmented rolls, which are less expensive due to their requiring less material for manufacture. Either a full roll configuration or a segmented roll configuration is susceptible to sheet creasing in the center. The cause of this sheet creasing is the deskew mechanism in stalled roll registration mechanisms. An unequal buckle is formed and as the sheet feeds through the stalled rolls, a crease can result in the center. If the rolls are loaded equally across the width of the rolls, or higher in the center, creasing occurs. If the rolls are loaded higher at the outside edges, then the force exerted on the sheets result in a simultaneous ironing motion toward the inboard and outboard edges of the sheet upstream of the registration rolls as the sheet passes through the nip.

As illustrated in FIG. 2A, the segmented non-cylindrical rolls are illustrated, 130,132, on drive shaft 134. The sheet 48 is shown being stalled in roll assembly 125. The sheet 48 is fed in the direction of arrow 140 by drive nip assembly 120 to the nip formed between the drive rolls 130, 132 and the segmented idler rolls 136. The drive nip continues to feed the sheet 48 into the stalled nip so that a buckle begins to form (FIG. 2B). The buckle in the sheet 48 forces the lead edge of the sheet to align in the nip formed between 130,132 and idler rolls 136. Once the sheet is aligned in the nip the drive rolls 130, 132 are actuated. A full width idler roll may also be used in place of the segmented rolls as illustrated.

As a result of the truncated conical shape of the drive rolls 130, 132, the velocity vectors of the segmented non-cylindrical rolls are greater toward the outer edges of the paper path than toward the center of the path. These vectors are illustrated by arrows 144, 142, which illustrate the effect of having the segmented roll diameter larger toward the outboard edges of the sheet. The outer edges of the rolls 130,132 will travel at a faster velocity because the effective diameter at the edge is larger and since the angular velocity (the speed of the driveshaft 134) is fixed, the outer edge of each roll has a higher linear surface velocity than the rest of the roll. Also, the elastomer deforms outwardly toward the edges when compressed, thus "ironing" the sheet flat. The larger effective edge diameter can be accomplished in several ways. As illustrated, there is a truncated, slightly conical shape for an elastomeric drive roll 130,132.

The result of the greater linear surface velocity is illustrated in FIG. 2C. An ironing effect is created as the sheet 48 is fed through the nip between drive rolls 130,132 and idlers 136. This effect is schematically illustrated by arrows 150. A 5% increase in diameter at the outside edges is sufficient to create the ironing effect illustrated by arrows 150 which help to minimize the possibility of center sheet crease. It should be noted that the conical shape of the roll is tapered and is not a stepped shape as illustrated. The conical effect can also be applied to a full width roll configuration or to the segmented registration rolls as illustrated. A benefit of the segmented approach is that the idler shaft and rolls can be mounted in any way and the load to the idler can be applied in any manner, for example, spring tangs which are biased, flexible arms, do not need to be mounted immediately adjacent to the outside edges. The ironing effect is particularly effective when there has been a lot of deskew action.

While the invention herein has been described in the context of a pretransfer sheet feeder, it will be readily apparent that the stalled roll registration mechanism can be used anywhere in a printing machine where sheets must be fed in a timed, registered position to a processing station. Thus, the device could be used within the printing machine to forward a copy sheet to the photoreceptor in a timed relation, or could also be used in a document handler for forwarding original sheets to be copied to a platen or scanner. Another advantage of the present system is that it provides an inexpensive and reliable system for stalled roll registration and deskewing which minimizes the chance of creasing the sheets as they pass through the device. This also helps to deliver a flattened sheet to the transfer station.

In recapitulation, there is provided a stalled roll registration device that minimizes or prevents creasing of a sheet as it is fed through the device. The rolls that register the sheet are not perfectly cylindrical and have a larger radius toward the outside edges of the sheetpath. After the sheet is stalled and then started through the registration pair, the velocity difference caused by the noncylindrical rolls causes the edges of the sheet to be urged toward the edges of the sheet path thereby minimizing the risk of wrinkling the sheet.

It is, therefore, apparent that there has been provided in accordance with the present invention, a stalled roll registration nip that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for registering a sheet in a path, comprising:

an idler member located in the path; and a drive member in circumferential contact along substantially its entire length with said idler member to form a nip therebetween, said drive member being noncylindrical, so that the effective velocity of said drive member at a first edge and a second edge of the sheet path, which first edge and second edge are toward an outer portion of the sheet path, is greater than an effective velocity of the drive member at a location between said first edge and said second edge at a location toward a center of the sheet path.

2. An apparatus according to claim 1, wherein said drive member comprises:

a drive shaft;

a plurality of roll sections, each of said roll sections being configured in the shape of a truncated cone, so that the diameter of each of said roll sections is greater at a first end than at a second end.

3. An apparatus according to claim 1, wherein said drive member comprises:

a drive axle; and a tapered roll mounted on said drive axle, so that the diameter of the tapered roll is less at the center of said rolls than at an outboard edge of said roll.

4. An apparatus for registering a sheet in a path, comprising:

an idler member located in the path;

a drive member in contact with said idler member to form a nip therebetween, said drive member being noncylindrical, wherein said drive member comprises a drive shaft and a plurality of roll sections, each of said roll sections being configured in the shape of a truncated cone, so that the diameter of each of said roll sections is greater at a first end than at a second end so that the effective velocity of said drive member at a first edge and a second edge of the sheet path, which first edge and second edge are toward an outer portion of the sheet path, is greater than an effective velocity of the drive member at a location between said first edge and said second edge at a location toward a center of the sheet path; and a second drive nip, located in the path preceding said drive member so that said second drive nip causes a sheet to be driven into a stalled nip formed by said drive member and said idler member to form a sheet deskew buckle.

5. A printing machine in which a sheet is driven along a path and fed in a timed relationship and registration position to a process station, comprising:

an idler member located in the path; and a drive member in circumferential contact along substantially its entire length with said idler member to form a nip therebetween, said drive member being noncylindrical, so that the effective velocity of said drive member at a first edge and a second edge of the sheet path, which first edge and second edge are toward an outer portion of the sheet path, is greater than an effective velocity of the drive member at a location between said first edge and said second edge at a location toward a center of the sheet path.

6. A printing machine according to claim 5, wherein said drive member comprises:

a drive shaft;

a plurality of roll sections, each of said roll sections being configured in the shape of a truncated cone, so that the diameter of each of said roll sections is greater at a first end than at a second end.

7. A printing machine according to claim 6, wherein said drive member comprises:

a drive axle; and a tapered roll mounted on said drive axle, so that the diameter of the tapered roll is less at the center of said rolls than at an outboard edge of said roll.

8. A printing machine in which a sheet is driven along a path and fed in a timed relationship and registration position to a process station, comprising:

an idler member located in the path;

a drive member in contact with said idler member to form a nip therebetween, said drive member being noncylindrical, wherein said drive member comprises a drive shaft and a plurality of roll sections, each of said roll sections being configured in the shape of a truncated cone, so that the diameter of each of said roll sections is greater at a first end than at a second end so that the effective velocity of said drive member at a first edge and a second edge of the sheet path, which first edge and second edge are toward an outer portion of the sheet path, is greater than an effective velocity of the drive member at a location between said first edge and said second edge at a location toward a center of the sheet path; and a second drive nip, located in the path preceding said drive member so that said second drive nip causes a sheet to be driven into a stalled nip formed by said drive member and said idler member to form a sheet deskew buckle.

* * * * *